US006439020B1

(12) United States Patent
Baschnagel, III et al.

(10) Patent No.: US 6,439,020 B1
(45) Date of Patent: Aug. 27, 2002

(54) GUTTER FORMING MACHINE

(76) Inventors: Robert J. Baschnagel, III, 162-21 Powells Cove Blvd. #6M, Whitestone, NY (US) 11357; Robert J. Baschnagel, Jr., 14-65 162nd St., Whitestone, NY (US) 11357

( * ) Notice: Subject to any disclaimer, the term of this patent is extended or adjusted under 35 U.S.C. 154(b) by 0 days.

(21) Appl. No.: 09/822,140

(22) Filed: Mar. 30, 2001

(51) Int. Cl.[7] ..... B21D 5/08
(52) U.S. Cl. ..... 72/181
(58) Field of Search ..... 72/181, 179, 176

(56) References Cited

U.S. PATENT DOCUMENTS

| | | | | | |
|---|---|---|---|---|---|
| 2,493,415 | A | * | 1/1950 | Navin | 72/181 |
| 2,944,583 | A | | 7/1960 | Welindt | |
| 3,589,159 | A | | 6/1971 | Warstler | |
| 3,612,453 | A | * | 10/1971 | Zimmer | 248/48.2 |
| 4,242,898 | A | | 1/1981 | Salvagnini | |
| 4,356,716 | A | | 11/1982 | Aschauer | |
| 4,899,566 | A | * | 2/1990 | Knudson | 72/181 |
| 5,239,853 | A | | 8/1993 | Kutschker | |
| 5,551,272 | A | * | 9/1996 | Knudson | 72/181 |
| D393,523 | S | | 4/1998 | Tambussi | |
| 5,740,687 | A | * | 4/1998 | Meyer et al. | 72/181 |

FOREIGN PATENT DOCUMENTS

| | | | | |
|---|---|---|---|---|
| AT | 179464 | * | 9/1954 | 72/181 |
| DE | 881334 | * | 6/1953 | 72/181 |
| JP | 238037 | * | 11/1985 | 72/181 |

* cited by examiner

*Primary Examiner*—Daniel C. Crane

(57) ABSTRACT

A gutter forming machine for forming a gutter having a vertically extended back wall for mounting the gutter on a structure. The gutter forming machine includes a plurality of upper rollers for contacting an upper surface of the material strip and a plurality of lower rollers for contacting a lower surface of the material strip. A lower roller support structure supports the plurality of lower rollers along the path and an upper roller support structure supports the plurality of upper rollers along the path. An auxiliary forming assembly is adapted for contacting a portion of the lower surface of the material strip for forming a portion of the back wall of the gutter. The auxiliary forming assembly comprises a plurality of auxiliary roller assemblies for contacting and guiding a portion of the material strip for forming an extended portion of the back wall of the gutter that extends away from the bottom wall beyond the first plane of the upper lip of the front wall. Optionally, a pair of edge guide rails are provided for guiding the material strip along at least a portion of the path, with the edge guide rails being laterally spaced for engaging the front and back side edges of the material strip. Optionally, a stiffener assembly is provided for forming a stiffening bead in the material strip adjacent to the back edge of the material strip.

16 Claims, 7 Drawing Sheets

GUTTER FORMING MACHINE

BACKGROUND OF THE INVENTION

1. Field of the Invention

The present invention relates to metal forming machines and more particularly pertains to a new gutter forming machine for forming a gutter having a vertically extended back wall for mounting the gutter on a structure.

2. Description of the Prior Art

The use of metal forming machines is known in the prior art. More specifically, metal forming machines have been heretofore devised and utilized for forming gutters having front and back and bottom walls. The typical gutter formed by these machines have front and back walls that extend substantially the same distance from the bottom wall of the gutter, such as shown in FIG. 1. This is especially true of gutters formed by machines designed to "continuously" form long lengths of gutters. The known gutter forming machines are limited to forming gutters that have front and back walls that are substantially the same heights with respect to the bottom wall.

Gutters which have back walls which are substantially the same height as the front wall tend to be difficult to mount on a structure in a properly sloped manner that induces the flow of water along the gutter toward a downspout draining the gutter. The gutter must be attached (e.g., such as by nails or screws) to the structure in a manner producing a slope, thus requiring the installer of the gutter to slope the gutter simply by attaching various portions of the gutter to the structure at different vertical heights. This can be difficult to accomplish, especially at the height of the edge of a roof of a structure. The proper sloping of the gutter is thus left to the skill of the installer, and satisfactory results are not always accomplished.

In these respects, the gutter forming machine according to the present invention substantially departs from the conventional concepts and designs of the prior art.

SUMMARY OF THE INVENTION

In view of the foregoing disadvantages inherent in the known types of metal forming machines now present in the prior art, the present invention provides a new gutter forming machine construction wherein the same can be utilized for forming a gutter having a vertically extended back wall for mounting the gutter on a structure.

To attain this, the present invention generally comprises a plurality of upper rollers for contacting an upper surface of the material strip and a plurality of lower rollers for contacting a lower surface of the material strip. A lower roller support structure supports the plurality of lower rollers along the path and an upper roller support structure supports the plurality of upper rollers along the path. An auxiliary forming assembly is adapted for contacting a portion of the lower surface of the material strip for forming a portion of the back wall of the gutter. The auxiliary forming assembly comprises a plurality of auxiliary roller assemblies for contacting and guiding a portion of the material strip for forming an extended portion of the back wall of the gutter that extends away from the bottom wall beyond the first plane of the upper lip of the front wall. Optionally, a pair of edge guide rails are provided for guiding the material strip along at least a portion of the path, with the edge guide rails being laterally spaced for engaging the front and back side edges of the material strip. Optionally, a stiffener assembly is provided for forming a stiffening bead in the material strip adjacent to the back edge of the material strip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
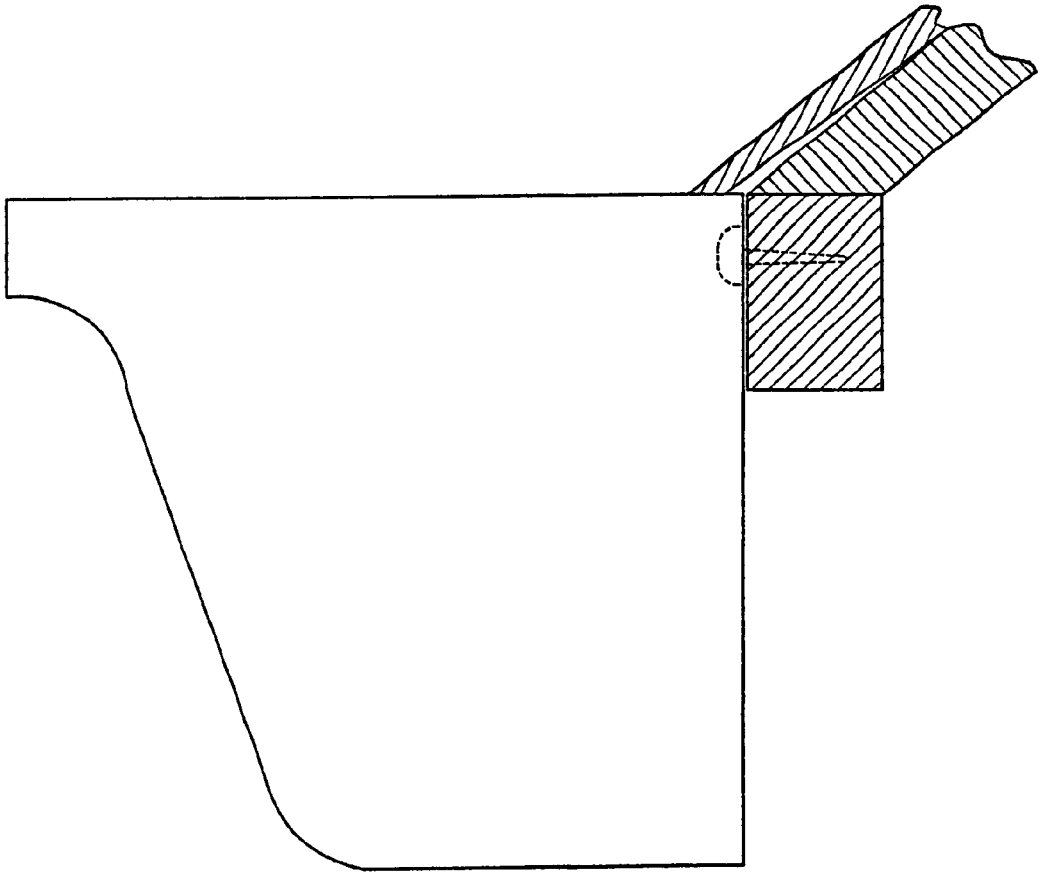
FIG. 1 PRIOR ART
FIG. 1 is an end view of a prior art gutter.

With reference now to the drawings, and in particular to FIGS. 1 through 7 thereof, a new gutter forming machine embodying the principles and concepts of the present invention and generally designated by the reference numeral 20 will be described.

Figure 2:
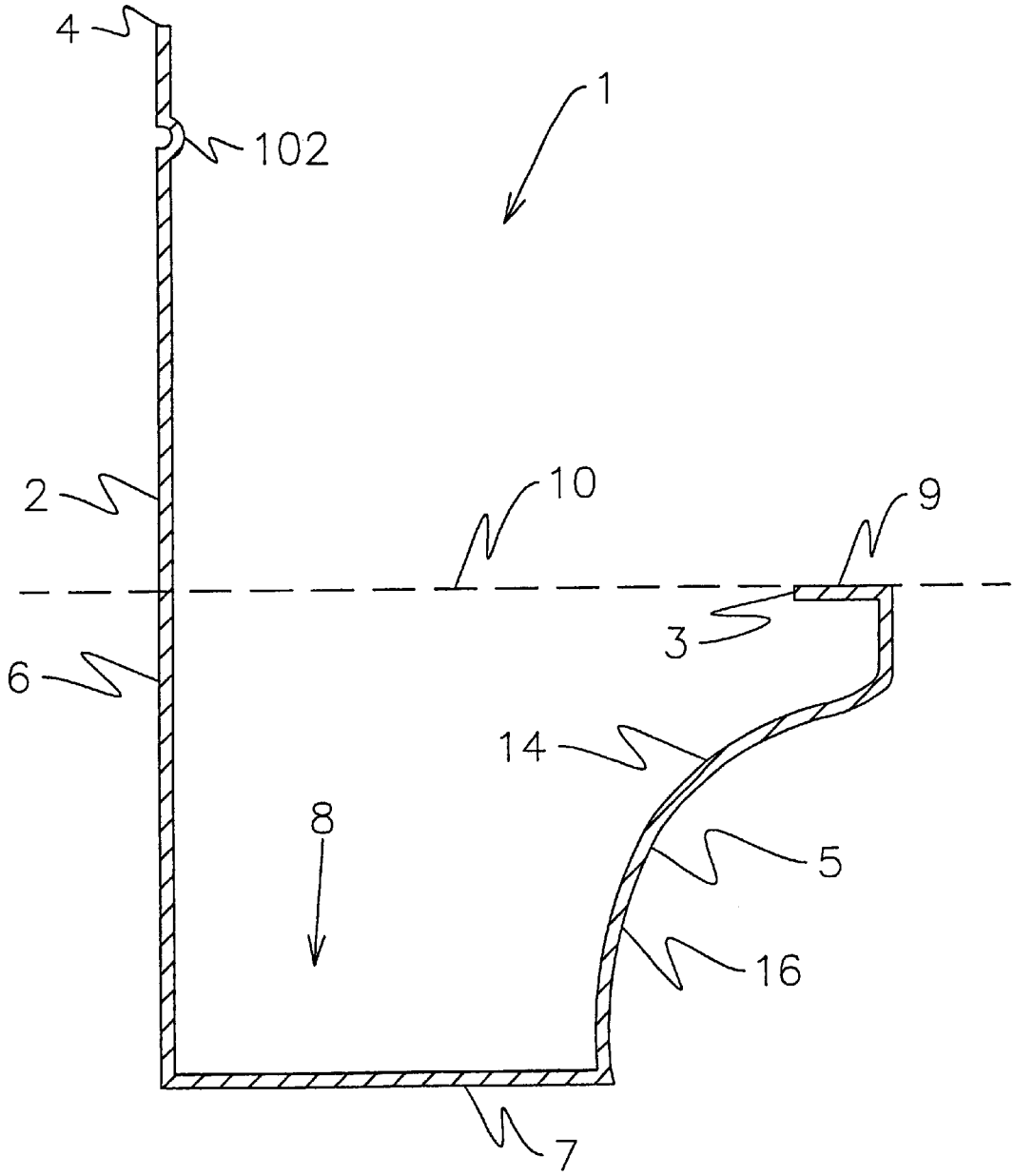
FIG. 2 is a schematic end sectional view of a gutter formed by the gutter forming machine according to the present invention.
Figure 3:
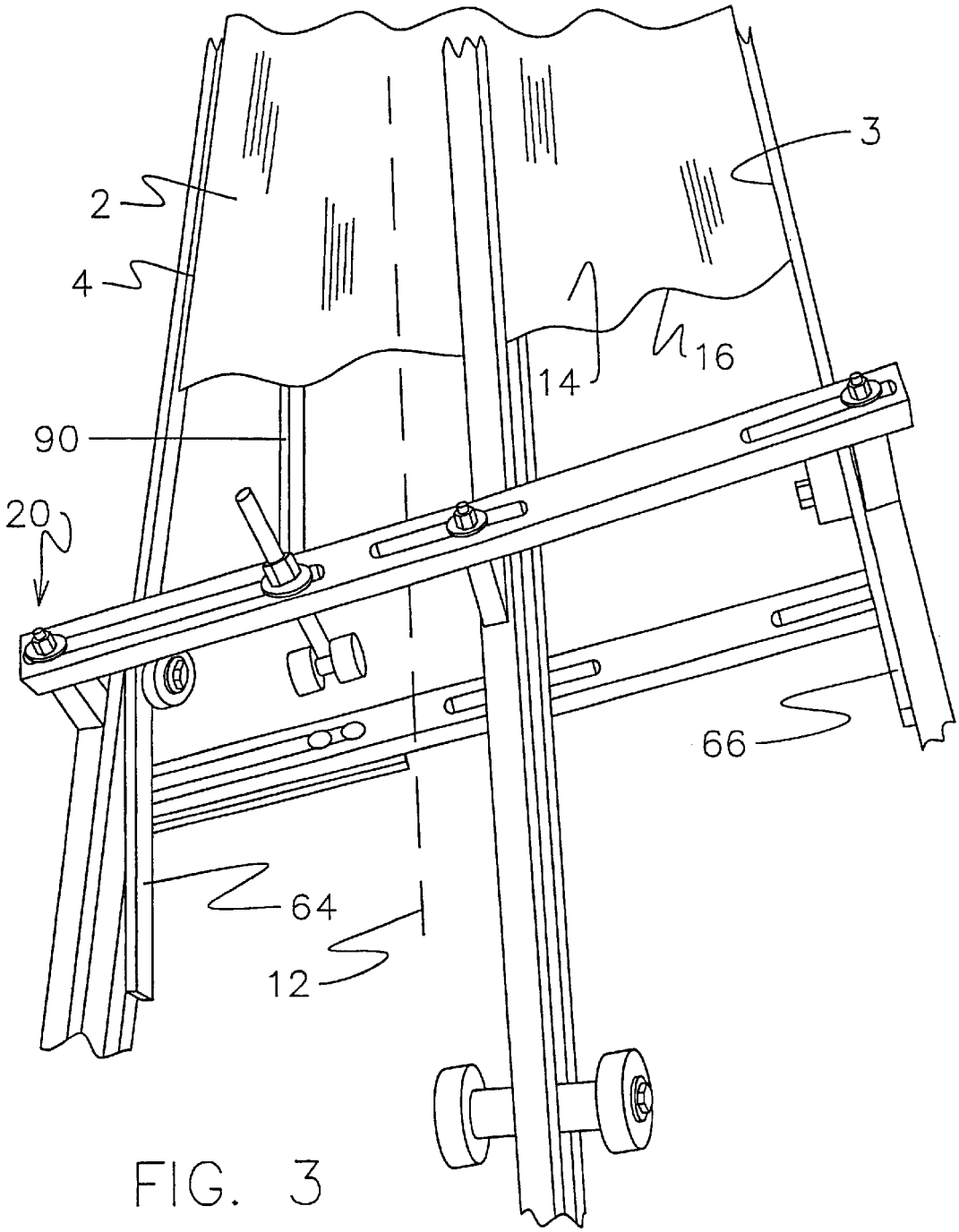
FIG. 3 is a schematic perspective view of a beginning portion of the path through the gutter forming machine.
Figure 4:
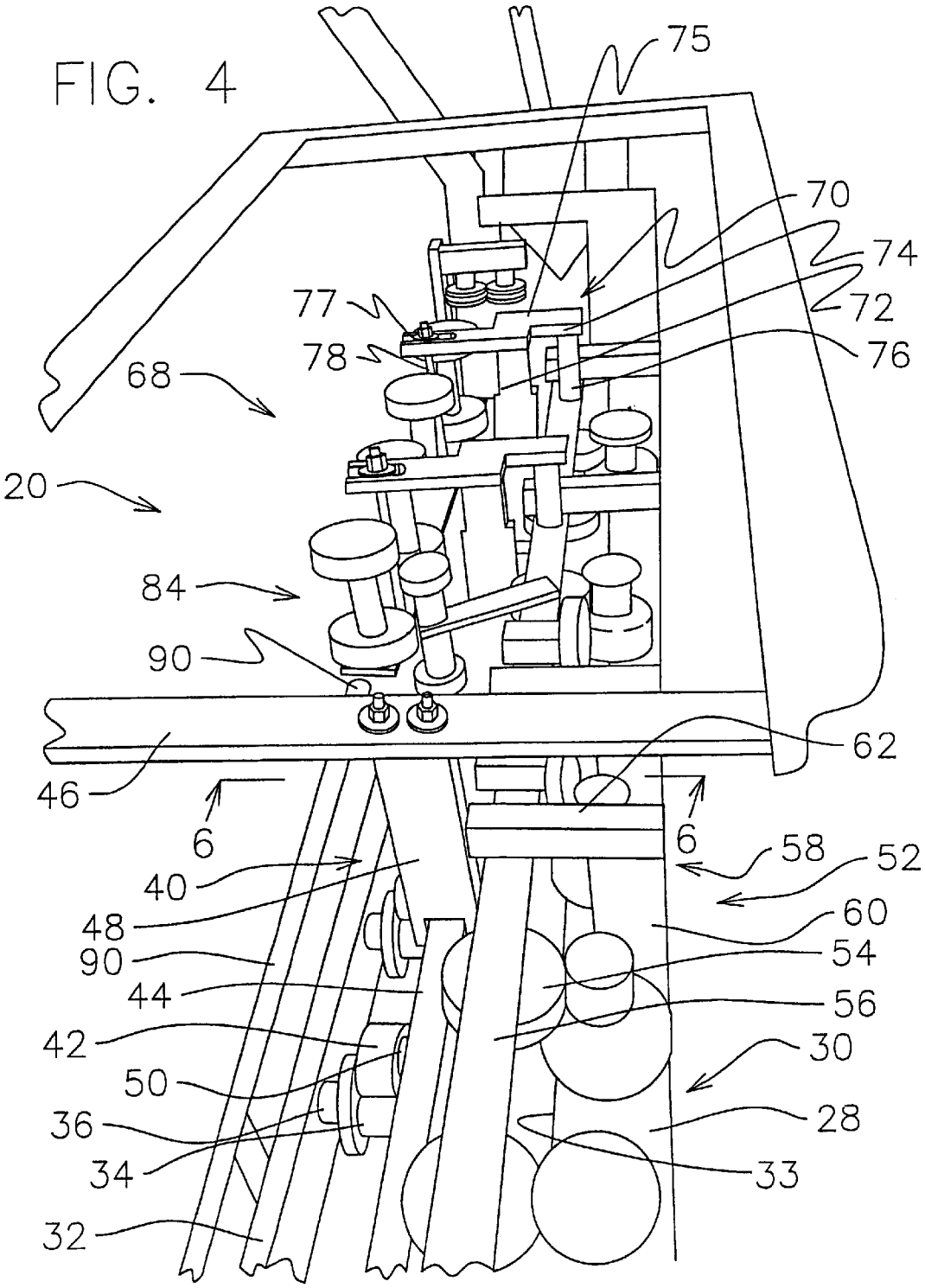
FIG. 4 is a schematic perspective view of an intermediate portion of the path through the gutter forming machine.
Figure 5:
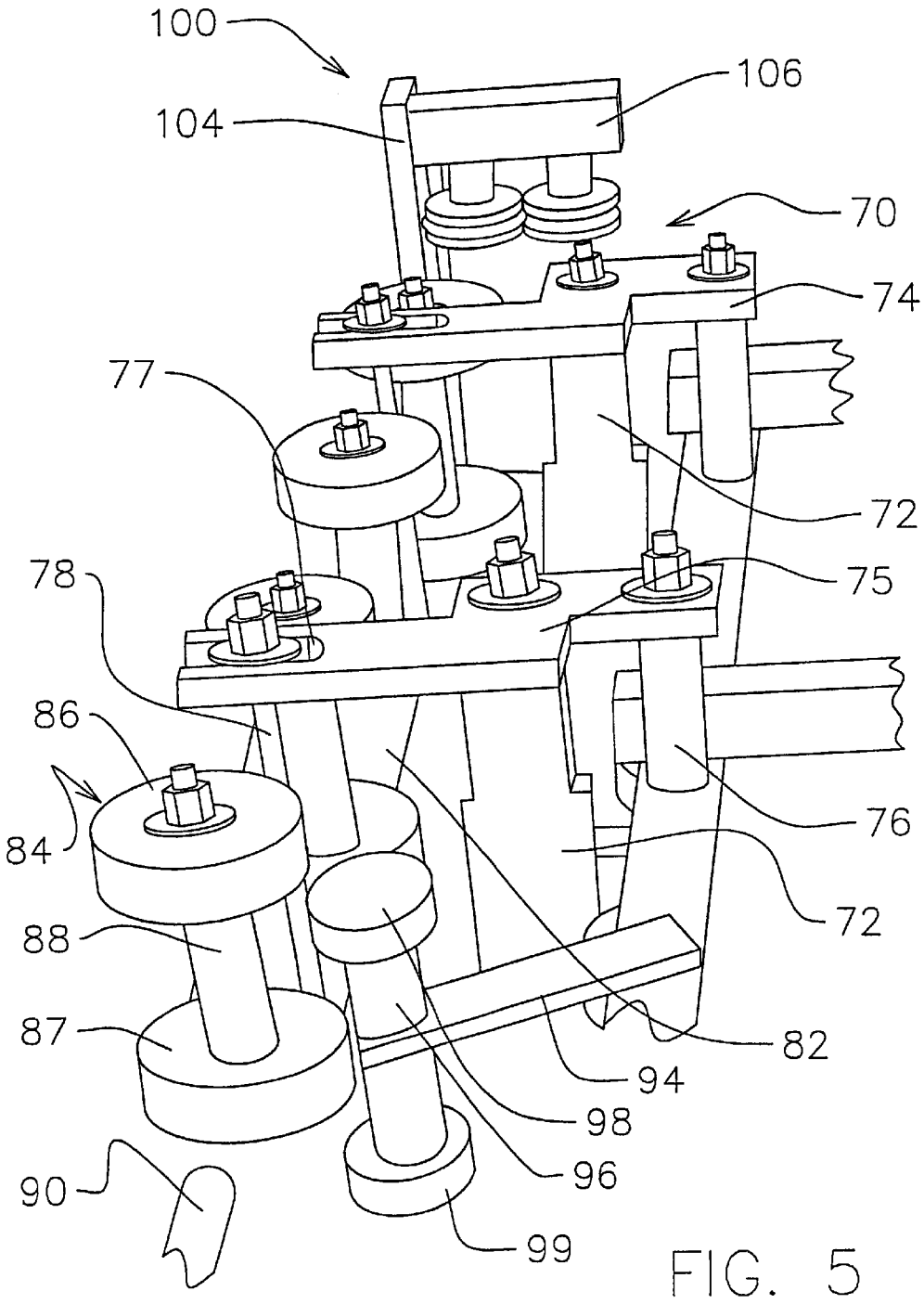
FIG. 5 is a schematic perspective view of an auxiliary forming assembly of the present invention.
Figure 6:
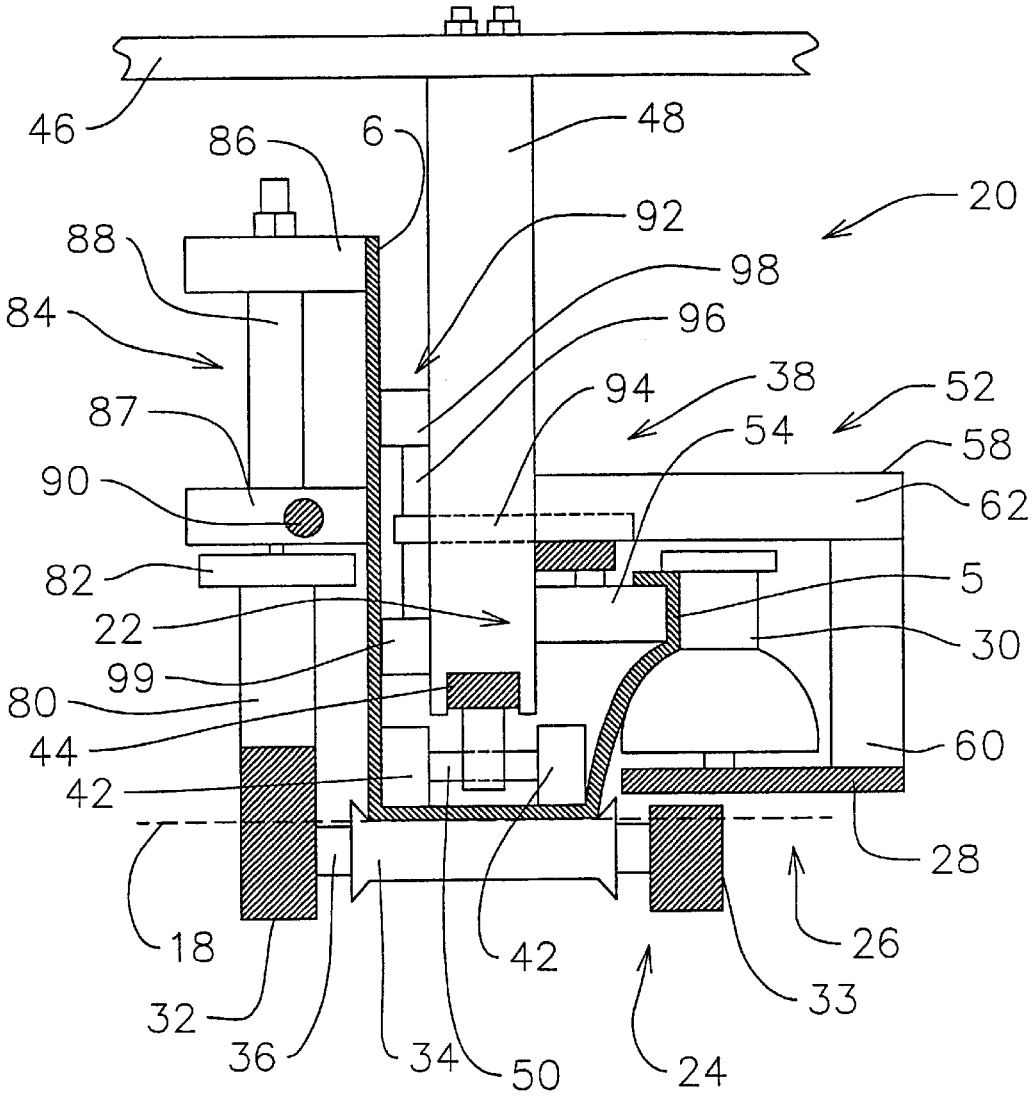
FIG. 6 is a schematic sectional view of the gutter forming machine taken along line 6—6 of FIG. 4.
Figure 7:
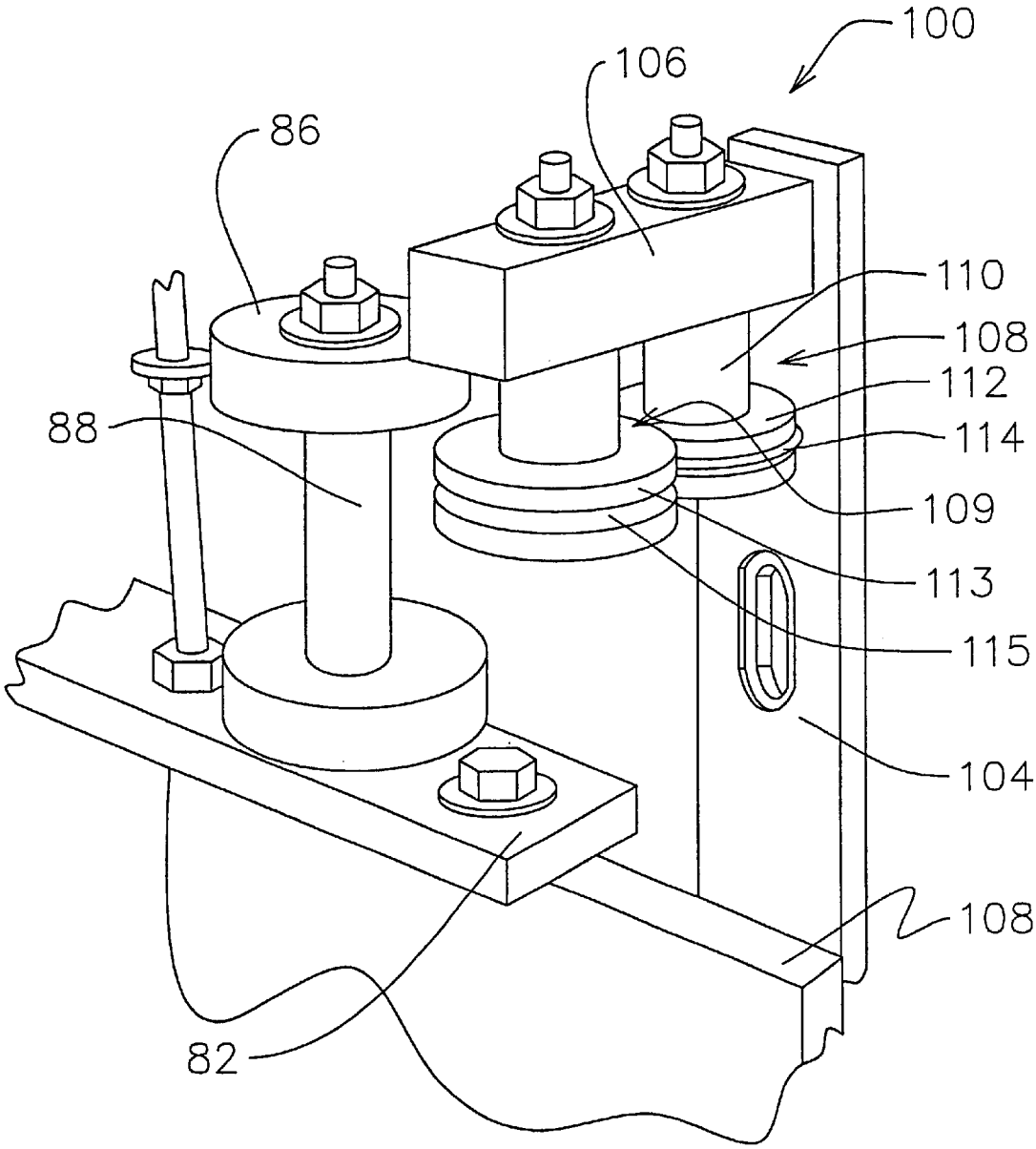
FIG. 7 is a schematic perspective view of a portion of an end portion of the path through the gutter forming machine.

The invention generally involves a gutter forming machine 20 for forming a continuous length of gutter 1 from a flat material strip 2 having a pair of opposite side edges 3, 4. The continuous length of gutter that is formed has a front wall 5, a back wall 6 and a bottom wall 7 that extends between the front and back walls. The front, back and bottom walls of the gutter define a channel 8. A front 3 one of the side edges of the strip forms a portion of the front wall 5 of the gutter and a back 4 one of the side edges of the strip forms a portion of the back wall 6 of the gutter. The front wall of the formed gutter has an upper lip 9 that extends in a first plane 10 that is oriented in a plane extending substantially parallel to the bottom wall, and substantially perpendicular to a plane of the back wall. The front wall may have an arcuate shape as shown in FIG. 2, although a substantially S-shaped front wall may also be formed by the machine.

The gutter forming machine 20 has a path along which the material strip moves through the machine, and the path has a longitudinal axis 12 extending between a beginning of the path and an end of the path. The substantially planar material strip 2 entering the machine at the beginning of the path forms a material plane from which the portions of the material strip are formed into the front and back walls.

Broadly, the gutter forming machine comprises a plurality of upper rollers 22 for contacting an upper surface 14 of the material strip and a plurality of lower rollers 24 for contacting a lower surface 16 of the material strip 2.

A lower roller support structure 26 is provided for supporting the plurality of lower rollers along the path. The lower roller support structure includes an outer rail 28 that extends along the path for supporting a first group 30 of the plurality of the lower rollers. The first group of the plurality of lower rollers is mounted on the outer rail, and may be mounted on an upper surface of the outer rail. The first group of the lower rollers is adapted to form a portion of the strip adjacent to the front side edge 3 into a portion of the front wall 5 of the gutter 1. Further, a pair of base rails 32, 33 are provided for supporting a second group 34 of the plurality of the lower rollers for forming the bottom wall of the gutter. Each of the base rails extends along a portion of the path, with the base rails being laterally spaced. The second group 34 of lower rollers is mounted on the pair of base rails 32, 33 by a plurality of base axles 36 that extend between the base rails at longitudinally spaced locations along the path. A pair of the second group of lower rollers is mounted on each of the base axles for contacting the lower surface 16 of the material strip.

An upper roller support structure 38 is provided for supporting the plurality of upper rollers along the path. The upper roller support structure includes a press bar assembly 40 for supporting a first group 42 of the plurality of upper rollers. The first group of the plurality upper rollers is adapted for contacting a portion of the upper surface 14 of the material strip for forming the bottom wall 7 of the gutter. The press bar assembly comprises a press bar 44, press bar supports 46, and saddle members 48. The press bar 44 is positioned along the path of the material strip, with the press bar extending in a substantially horizontal orientation. The first group 42 of the plurality of upper rollers is mounted on the press bar. A plurality of press bar axles 50 are mounted on the press bar, with a pair of the first group 42 of the upper rollers being mounted on each of the press bar axles. A plurality of the press bar supports 46 extends above the press bar. Each of the press bar supports may extend in a substantially horizontal orientation, and in such an orientation each of the press bar supports extends substantially perpendicularly to the press bar. A plurality of the saddle members 48 supports the press bar from the press bar supports. Each of the saddle members extends from one of the press bar supports to the press bar, and the saddle members may extend in a substantially vertical orientation.

An upper rail assembly 52 is provided for supporting a second group 54 of the plurality of upper rollers, which are adapted for contacting a portion of the upper surface 14 of the material strip for forming the front wall 5 of the gutter. The upper rail assembly includes an upper rail member 56 that is positioned along the path of the material strip, and may extend in a substantially horizontal orientation. The second group 54 of upper rollers is mounted on the upper rail member, and may be mounted on a lower face of the upper rail member. The upper rail assembly may also include a plurality of upper rail member support structures 58, with each of the upper rail support structures including a post member 60 and a linking member 62. The post member 60 has an upper end and a lower end, with the lower end being mounted on the outer rail 28. The post member may be substantially vertically oriented. The linking member 62 links the upper rail member 56 to the post member 60 on the outer rail 28. The linking member has a first end that is mounted on the upper rail member and a second end that is mounted on the upper end of the post member.

One significant feature of the invention is the inclusion of a pair of edge guide rails 64, 65, that are provided for guiding the material strip along at least a portion of the path through the machine and facilitating a relatively straight feed of the material strip along the path into the machine. The edge guide rails 64, 65 are laterally spaced for engaging the front 3 and back 4 side edges of a material strip oriented in the path. The lateral spacing between the edge guide rails may be adjusted to the particular width of the material strip being formed. The edge guide rails 64, 65 extend through the material plane for obstructing lateral movement of the material strip from the path. Preferably, the edge guide rails extend at least along a first portion of the path in which the material strip is still in a substantially planar configuration, and prior to significant forming of the strip into the gutter configuration.

Another significant feature of the invention is an auxiliary forming assembly 68 that is adapted for contacting a portion of the lower surface 16 of the material strip for forming a portion of the back wall 6 of the gutter. The auxiliary forming assembly includes structure adapted to support a portion of the material strip for forming that portion into an extension of the back wall of the gutter that extends a distance from the bottom wall that is significantly greater than heretofore known gutter configurations, such that the back wall of the gutter formed extends upwardly beyond the plane of the upper lip 9 formed by the front side edge 3 of the material strip. The auxiliary forming assembly preferably includes at least one forming assembly support structure 70, and most preferably includes two forming assembly support structures. Each forming assembly support structure 70 may include a stanchion 72 mounted on the press bar 44, a cantilever member 74 mounted on the stanchion, a buttress 76 mounted between the cantilever member and the upper rail member of the upper rail assembly, and a mounting member 78 depending from the cantilever member.

The stanchion 72 of the assembly support structure is mounted on the press bar 44 and extends upwardly from the press bar. The stanchion has a first end that is mounted on the press bar and a second end that mounted on the cantilever member 74. The stanchion may be substantially vertically oriented. Further, a threaded bore (not shown) may be formed in the second (upper) end of the stanchion. The cantilever member 74 of the assembly support structure is mounted on the stanchion. The cantilever member has first and second ends, with an intermediate portion 75 of the cantilever member (between the ends) being mounted on the second (upper) end of the stanchion. Illustratively, the cantilever member may be bolted to the stanchion using the threaded bore in the stanchion. The first end of the cantilever member may have a slot 77 formed therein, with the slot extending from the first end of the cantilever member in a longitudinal direction toward the second end of the cantilever member. The buttress 76 of the assembly support structure is mounted between the cantilever member 74 and the upper rail member 56 of the upper rail assembly, with a first end of the buttress being mounted on the upper rail member and a second end of the buttress being mounted on the second end of the cantilever member. The mounting member 78 depends downwardly from the cantilever member, with a first end of the mounting member being mounted on the first end of the cantilever member. Preferably, the slot 77 in the first end of the cantilever member is employed for mounting the first (upper) end of the mounting member. The mounting member also has a second (lower) end.

An extension wall 80 is mounted on one of the base rails, preferably the base rail 32 located furthest from the upper rail member 56. The extension wall 80 extends upwardly from the base rail. An auxiliary support bar 82 is mounted on the extension wall, preferably on an upper most edge of the extension wall. While the width of the extension wall 80 preferably extends in a vertical direction, the width of the auxiliary support bar 82 preferably extends in a horizontal direction, while the length of the auxiliary support bar extends along the extension wall. The second, and lowermost, end of the mounting member 78 of the forming assembly support structure 70 is mounted on the auxiliary support bar 82, so that the second end of the cantilever member 74 is supported above the auxiliary support bar. The combination of the stanchion 72, the cantilever member 74, and the mounting member 78 creates an area of enhanced vertical clearance between the press bar 44 and the base rail 32 (having the extension wall mounted thereon) for passage of the material strip forming the extended back wall of the gutter.

Significantly, a plurality of auxiliary roller assemblies 84 are provided for contacting and guiding and supporting a portion of the material strip for forming the extended portion of the back wall 6 of the gutter moving through the gutter forming machine. In the exemplary embodiment of the invention, the plurality of auxiliary roller assemblies comprises four auxiliary roller assemblies, although fewer or more assemblies may be used. Each of the auxiliary roller assemblies 84 preferably comprises a pair of rollers 86, 87, and an auxiliary axle 88 on which the pair of rollers are mounted. One 86 of the pair of auxiliary rollers may be mounted toward an upper end of the auxiliary axle and one 87 of the pair of auxiliary rollers may be mounted toward a lower end of the auxiliary axle. The auxiliary axle is preferably oriented in a vertical direction such that the auxiliary rollers rotate about a substantially vertical axis. A lower end of the auxiliary axle is mounted on an upper surface of the auxiliary support bar 82.

Another significant feature of the invention for forming the extended back wall of the gutter from the material sheet is a forming rail 90 that abuts the lower surface 16 of the material strip adjacent to the back side edge 4. The forming rail extends along at least a portion of the path of the material strip through the machine. The forming rail is positioned between the edge guide rails 64, 65, when the edge guide rails are employed. The forming rail extends below the material plane 18 at a location towards the beginning of the path, such as where the material strip is substantially planar or flat prior to bending or forming of the strip. The forming rail extends gradually upward from below the material plane to a position adjacent the lower auxiliary roller 87 of a first one of the auxiliary roller assemblies for guiding a portion of the material to the lower roller of the first auxiliary roller assembly. The forming rail should rise from below the material plane to a vertical level that is at least as high as the lower auxiliary roller, and preferably is above the first plane of the gutter as the material strip moves through the machine. The forming rail 90 thus is highly useful for moving the portion of the material strip into a more vertical orientation as the rollers are forming the bottom and front walls.

An alignment roller assembly 92 may be included for pressing the material strip against the auxiliary roller assemblies. In the exemplary embodiment of the invention, the alignment roller assembly 92 is mounted along the path before a first one of the auxiliary roller assemblies, although other locations along the material path may be employed. The alignment roller assembly may include a positioning bar 94 which is mounted on the upper rail member, an alignment roller axle 96 mounted on the positioning bar, and a pair of alignment rollers 98, 99. The positioning bar 94 may extend from the upper rail member 56 toward at least one of the auxiliary roller assemblies. An axis of the alignment axle may be substantially vertically oriented, and each alignment roller may be mounted on an end of the alignment roller axle such that the alignment rollers are rotatable about a substantially vertical axis.

A stiffener assembly 100 may be included for forming a stiffening bead 102 in the material strip adjacent to the back edge of the material strip for keeping the extended back wall in a substantially planar condition as the gutter moves out of the machine and may be further formed on a bending brake. In the exemplary embodiment of the invention, the stiffener assembly 100 is located along the path after the plurality of auxiliary roller assemblies 92. The stiffener assembly includes an upright 104 that extends upwardly from the extension wall, with the upright preferably being mounted on the extension wall. An arm member 106 is mounted on the upright, and extends over the path. A pair of bead former assemblies 108, 109 is mounted on the arm member 106, with the pair of bead forming assemblies being spaced from each other in a direction transverse to the longitudinal axis of the path. Each of the bead former assemblies 108, 109 may comprise a spacer 110 that depends, or extends substantially downwardly, from the arm member 106. The spacer may be substantially vertically oriented. A relief roller is provided for pressing against a surface of the material strip. A first one 112 of the relief rollers is provided with a circumferential ridge 114 and a second one 113 of the relief rollers has a circumferential groove 115 adapted to press a portion of the material strip into the circumferential groove of the first relief roller when the material strip is passed between the first and second relief rollers.

After forming of the gutter with the extended back wall in the gutter forming machine of the invention, the continuous length of gutter may be cut to the desired length for the particular application. Preferably, the extended back wall is bent so that a flange is formed on an upper portion of the back wall adjacent the back side edge of the material strip. Most preferably, the band forming the flange is oriented along a line that slopes with respect to the bottom wall such that a bottom wall slope may be preformed on the gutter.

In an illustrative embodiment of the gutter formed by the machine of the invention, the back wall has a height of approximately 22.5 cm, and the bottom wall has a width of approximately 9.5 cm, and the front wall has a height measured parallel to the back wall of approximately 12 cm. The upper lip of the gutter has a width of approximately 2 cm. An upper portion of the front wall adjacent to the upper lip measures approximately 2.5 cm. The stiffening bead may be positioned approximately 1 cm below the rear side edge of the back wall.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A gutter forming machine for forming a continuous length of gutter from a flat material strip having a pair of opposite side edges, the continuous length of gutter formed being of the type having a front wall, a back wall and a bottom wall extending between the front and back walls, the front, back and bottom walls defining a channel of the gutter, the front wall having an upper lip extending in a first plane oriented substantially parallel to the bottom wall, the gutter forming machine comprising:

a plurality of upper rollers for contacting an upper surface of the material strip;

a plurality of lower rollers for contacting a lower surface of the material strip;

a lower roller support structure for supporting the plurality of lower rollers along the path;

an upper roller support structure for supporting the plurality of upper rollers along the path;

an auxiliary forming assembly adapted for contacting a portion of the lower surface of the material strip for forming a portion of the back wall of the gutter, the auxiliary forming assembly comprising a plurality of auxiliary roller assemblies for contacting and guiding a portion of the material strip for forming an extended portion of the back wall of the gutter that extends away from the bottom wall beyond the first plane of the upper lip of the front wall;

wherein a path is defined along which the material strip moves through the machine, and additionally comprising a pair of edge guide rails for guiding the material strip along at least a portion of the path, the edge guide rails being laterally spaced for engaging the front and back side edges of the material strip.

2. The machine of claim 1 wherein the auxiliary forming assembly comprises a forming rail for abutting the lower surface of the material strip adjacent to the back side edge, the forming rail extending along at least a portion of the path, the forming rail being positioned between the edge guide rails, the forming rail extending below a material plane towards a beginning of the path, the forming rail extending gradually upward from below the material plane to a position adjacent one of the plurality of auxiliary roller assemblies.

3. The machine of claim 1 wherein the auxiliary forming assembly includes a forming assembly support structure, the forming assembly support structure comprising:

a stanchion mounted on a press bar of the upper roller support structure, the stanchion extending upwardly from the press bar;

a cantilever member mounted on the stanchion;

a buttress mounted between the cantilever member and an upper rail member of the upper roller support structure; and a mounting member depending from the cantilever member.

4. The machine of claim 1 wherein the plurality of auxiliary roller assemblies comprises four auxiliary roller assemblies.

5. The machine of claim 1 wherein each of the auxiliary roller assemblies comprises:

a pair of auxiliary rollers; and an auxiliary shaft, one of the pair of auxiliary rollers being mounted toward an upper end of the auxiliary axle and one of the pair of auxiliary rollers being mounted toward a lower end of the auxiliary axle, the auxiliary axle being oriented in a vertical direction such that the auxiliary rollers rotate about a substantially vertical axis.

6. The machine of claim 5 wherein the lower roller support structure includes a pair of base rails for supporting a second group of the plurality of the lower rollers for contacting the lower surface of the material strip to form the bottom wall of the gutter, an extension wall being mounted on one of the base rails, the extension wall extending upwardly from the base rail;

an auxiliary support bar mounted on the extension wall, the auxiliary shaft being mounted on the auxiliary support bar.

7. The machine of claim 1 additionally comprising an alignment roller assembly for pressing the material strip against the auxiliary roller assemblies, the alignment roller assembly being mounted along the path before a first one of the auxiliary roller assemblies.

8. The machine of claim 7 wherein the alignment roller assembly comprises:

a positioning bar being mounted on an upper rail member of the upper roller support structure, the positioning bar extending from the upper rail member toward at least one of the auxiliary roller assemblies;

an alignment roller axle mounted on the positioning bar, an axis of the alignment axle being substantially vertically oriented; and a pair of alignment rollers, each alignment roller being mounted on an end of the alignment roller axle, the alignment rollers being rotatable about a substantially vertical axis.

9. The machine of claim 1 wherein a path is defined along which the material strip moves through the machine, wherein the plurality of lower rollers includes a first group of the lower rollers for forming a portion of the front wall of the gutter from a portion of the strip adjacent to the front side edge, and wherein the lower roller support structure includes an outer rail extending along the path, the first group of the plurality of lower rollers being mounted on the outer rail.

10. The machine of claim 1 wherein a path is defined along which the material strip moves through the machine, wherein the plurality of lower rollers includes a second group of the lower rollers for contacting the lower surface of the material strip to form the bottom wall of the gutter, and wherein the lower roller support structure includes a pair of base rails, the second group of lower rollers being mounted on the pair of base rails, each of the base rails extending along a portion of the path, the base rails being laterally spaced, a plurality of base axles extending between the base rails at longitudinally spaced locations along the path, a pair of the second group of lower rollers being mounted on each of the base axles.

11. The machine of claim 1 wherein the upper roller support structure includes a press bar assembly for supporting a first group of the plurality of upper rollers, the first group of the plurality upper rollers being adapted for contacting a portion of the upper surface of the material strip for forming the bottom wall of the gutter, the press bar assembly comprising:

a press bar being positioned along the path of the material strip, the press bar extending in a substantially horizontal orientation, a first group of the plurality of upper rollers being mounted on the press bar;

a plurality of press bar supports extending above the press bar, each of the press bar supports extending in a substantially horizontal orientation; and a plurality of saddle members for supporting the press bar from the press bar supports, each of the saddle members extending from one of the press bar supports to the press bar, each of the saddle members extending in a substantially vertical orientation.

12. The machine of claim 1 wherein the upper roller support structure includes an upper rail assembly for supporting a second group of the plurality of upper rollers, the second group of the upper rollers being adapted for contacting a portion of the upper surface of the material strip for forming the front wall of the gutter, the upper rail assembly comprising:

an upper rail member being positioned along the path of the material strip, the upper rail member extending in a substantially horizontal orientation, the second group of upper rollers being mounted on the upper rail member; and a plurality of upper rail member support structures, each of the upper rail support structures comprising:

a post member having an upper end and a lower end mounted on the outer rail, the post member being substantially vertically oriented; and a linking member linking the upper rail member to the post member on the outer rail, the linking member having a first end thereof being mounted on the upper rail member and a second end thereof being mounted on the upper end of the post member.

13. A gutter forming machine for forming a continuous length of gutter from a flat material strip having a pair of opposite side edges, the continuous length of gutter formed being of the type having a front wall, a back wall and a bottom wall extending between the front and back walls, the front, back and bottom walls defining a channel of the gutter, the front wall having an tipper lip extending in a first plane oriented substantially parallel to the bottom wall, the gutter forming machine comprising:

a plurality of upper rollers for contacting an upper surface of the material strip;

a plurality of lower rollers for contacting a lower surface of the material strip;

a lower roller support structure for supporting the plurality of lower rollers along the path;

an upper roller support structure for supporting the plurality of upper rollers along the path;

an auxiliary forming assembly adapted for contacting a portion of the lower surface of the material strip for forming a portion of the back wall of the gutter, the auxiliary forming assembly comprising a plurality of auxiliary roller assemblies for contacting and guiding a portion of the material strip for forming an extended portion of the back wall of the gutter that extends away from the bottom wall beyond the first plane of the upper lip of the front wall; and a stiffener assembly for forming a stiffening bead in the material strip adjacent to the back edge of the material strip.

14. The machine of claim 13 wherein a path is defined along which the material strip moves through the machine, and wherein the stiffener assembly is located along the path after the plurality of auxiliary roller assemblies.

15. The machine of claim 13 wherein the stiffener assembly comprises a pair of relief rollers for pressing against opposite surfaces of the material strip, wherein a first one of the relief rollers has a circumferential groove and a second one of the relief rollers has a circumferential ridge adapted to press a portion of the material strip into the circumferential groove of the first relief roller when the material strip is passed between the first and second relief rollers.

16. A gutter forming machine for forming a continuous length of gutter from a flat material strip having a pair of opposite side edges, the continuous length of gutter formed being of the type having a front wall, a back wall and a bottom wall extending between the front and back walls, the front, back and bottom walls defining a channel of the gutter, the front wall having an upper lip extending in a first plane oriented substantially parallel to the bottom wall, the gutter forming machine comprising:

a plurality of upper rollers for contacting an upper surface of the material strip;

a plurality of lower rollers for contacting a lower surface of the material strip;

a lower roller support structure for supporting the plurality of lower rollers along the path;

an upper roller support structure for supporting the plurality of upper rollers along the path;

an auxiliary forming assembly adapted for contacting a portion of the lower surface of the material strip for forming a portion of the back wall of the gutter, the auxiliary forming assembly comprising a plurality of auxiliary roller assemblies for contacting and guiding a portion of the material strip for forming an extended portion of the back wall of the gutter that extends away from the bottom wall beyond the first plane of the upper lip of the front wall;

wherein a path is defined along which the material strip moves through the machine, the auxiliary forming assembly comprises a forming rail for abutting the lower surface of the material strip adjacent to the back side edge, the forming rail extending along at least a portion of the path, the forming rail extending below a material plane towards a beginning of the path, the forming rail extending gradually upward from below the material plane to a position adjacent one of the plurality of auxiliary roller assemblies.

* * * * *